US005280783A

United States Patent [19]

Focht et al.

[11] Patent Number: 5,280,783

[45] Date of Patent: Jan. 25, 1994

[54] CONTINUOUS PASSIVE MOTION DEVICE FOR FULL EXTENSION OF LEG

[75] Inventors: Louise M. Focht; Robert S. Green; Richard A. Becker, all of San Diego, Calif.

[73] Assignee: Sutter Corporation, San Diego, Calif.

[21] Appl. No.: 953,984

[22] Filed: Sep. 29, 1992

[51] Int. Cl.[5] ..... A61H 1/02

[52] U.S. Cl. ..... 128/25 R

[58] Field of Search ..... 128/25 R, 25 B, 25 C; 482/137

[56] References Cited

U.S. PATENT DOCUMENTS

| | | | |
|---|---|---|---|
| 4,549,534 | 10/1985 | Zagorski et al. | 128/25 R |
| 4,566,440 | 1/1986 | Berner et al. | 128/25 C |
| 4,665,899 | 5/1987 | Farris et al. | 128/25 C |
| 4,798,197 | 1/1989 | Nippoldt et al. | 128/25 R |
| 4,825,852 | 5/1989 | Genovese et al. | 128/25 C |

*Primary Examiner*—Richard J. Apley
*Assistant Examiner*—Jeanne M. Mollo
*Attorney, Agent, or Firm*—Nydegger & Associates

[57] ABSTRACT

A continuous passive motion device for achieving full extension of the leg of a patient includes a base and a four-bar articulated limb support member which is mounted for movement on the base. For the articulated limb support member one bar is a femoral support member which is pivotally mounted on the base. Another one of the bars is a tibial support member which is pivotally joined to the femoral support member. Also included in the device is a drive bar which has a first end reciprocally mounted on the base of the device and a second end which is pivotally attached to the femoral support member. A cross bar having a first end pivotally attached to the tibial support member and having a second end pivotally attached to the drive bar interconnects the tibial support member and the drive bar. The device further includes a motor which is connected to the device for reciprocating the first end of the drive bar to alter the configuration of the device for exercising the leg. A method is disclosed for passively exercising the leg of a patient, using the above described device.

18 Claims, 3 Drawing Sheets

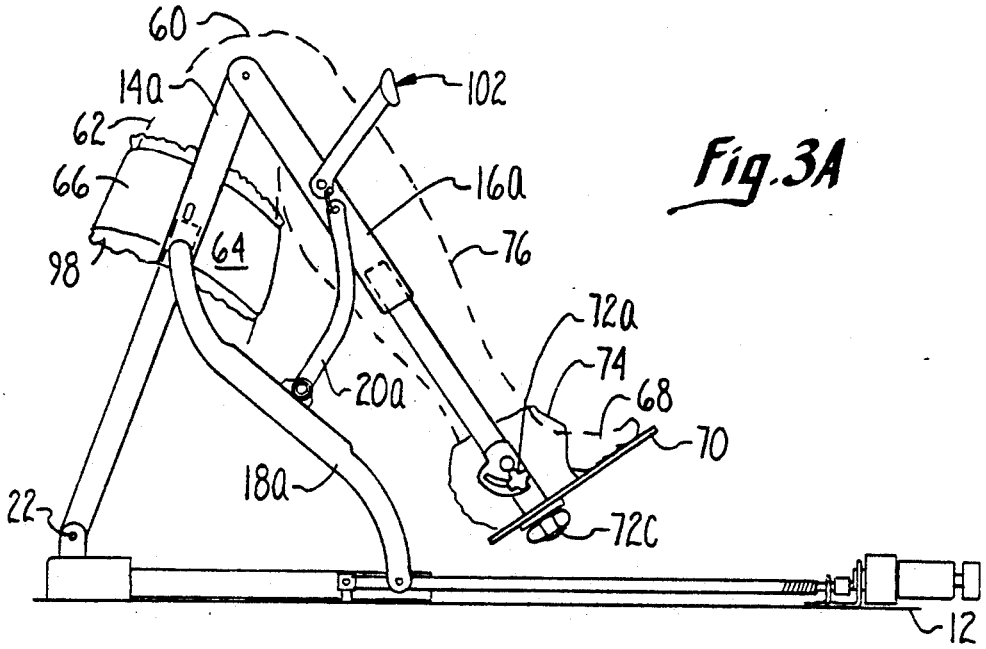
Fig. 3A
Fig. 3B
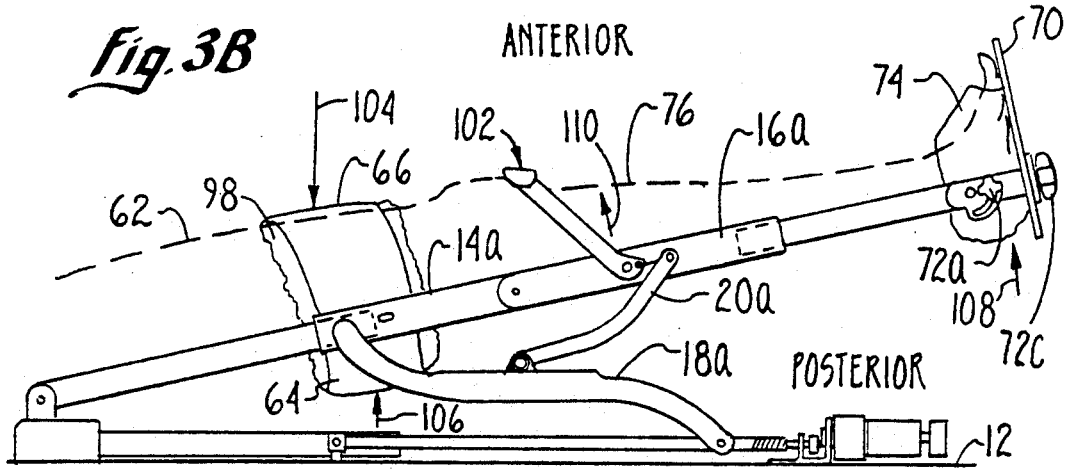
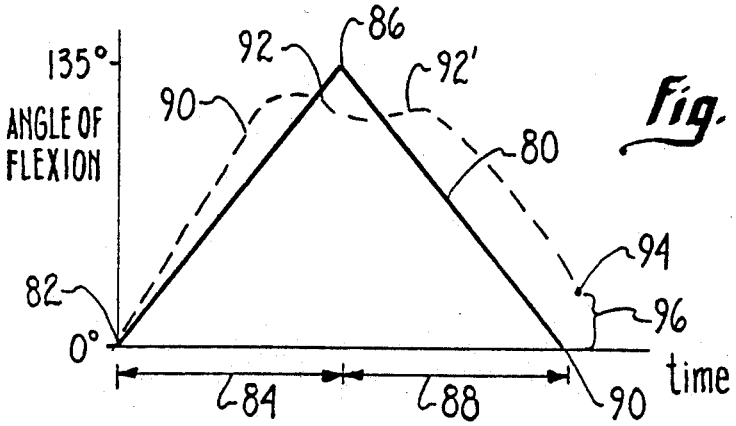
Fig. 4

CONTINUOUS PASSIVE MOTION DEVICE FOR FULL EXTENSION OF LEG

FIELD OF THE INVENTION

The present invention pertains generally to continuous passive motion (CPM) devices which are useful for rehabilitation therapy. More particularly, the present invention pertains to CPM devices which exercise articulable limbs. The present invention is particularly, but not exclusively useful for exercising a leg when it is necessary for the leg to be fully extended during the exercise.

BACKGROUND OF THE INVENTION

As is well known, there are many different types of leg injuries. Not surprisingly, each type of leg injury is characterized by its own complexities and requires its own special and unique form of treatment. Like other kinds of injuries where bones may be broken and tissue may be torn or ruptured, the healing and rehabilitation process for leg injuries is typically complicated. Normally, this healing process evolves in stages and, it is not uncommon for there to be different prescribed treatments during the different stages of the healing process. One form of rehabilitative therapy which is extensively used during prescribed portions of the leg healing process is accomplished using continuous passive motion (CPM) devices.

Unlike active motion of a leg which results when the patient has sufficient muscle strength to bend the joint and flex or extend the leg, passive motion is caused or induced by the application of external forces to the leg. Of course, passive motion can be manually accomplished by a trained therapist. This, however, can be very tiring for the therapist and can be somewhat inaccurate. Therefore, CPM is most often accomplished by attaching a mechanical device to the affected limb which will move the limb through a prescribed motion regimen for appropriate periods of time. It is well known that when such devices are properly used, continuous passive motion of a jointed limb can have several beneficial effects. To name but a few, continuous passive motion is known to reduce post-operative pain, to decrease muscle atrophy caused by immobility of the limb and, to enhance the speed of recovery.

For many prescribed rehabilitation therapy regimens, it is very important that the CPM device precisely accomplish the desired movement and articulation of the limb. In some instances, this needs to be accomplished even in opposition to any active forces which the patient may voluntarily or involuntarily create against the device. Stated differently, there are passive motion regimens for leg rehabilitation wherein it is essential that the leg be predictably moved, both as to time and position.

Several CPM devices have been proposed for use in therapy for the rehabilitation of legs. Though these devices commonly include an articulable base for supporting the leg, and an associated motor assembly for articulating this base, the specifics of their structures are conceived and designed with different purposes and objectives in mind. For example, U.S. Pat. No. 4,323,060 which issued to Precheux for an invention entitled "Splint" discloses a device which incorporates traction to provide some partial passive motion for the limb. Unlike the device of the present invention, the Precheux patent discloses a device which requires active movement by the patient to accomplish a full extension of the leg. Further, it relies on elastic members or counterweights to assist in this movement. In reality, the device of the Precheux is not a purely passive device. Another example is U.S. Pat. No. 4,566,440 which issued to Berner et al. for an invention entitled "Orthosis for Leg Movement with Virtual Hip Pivot". Essentially, the Berner et al. patent discloses a cradle on which the leg rests, and which requires a double, or stacked, four-bar assembly that must be intricately and precisely aligned to establish the virtual hip movement in accordance with the particular anatomy of the patient. The Berner et al. patent is primarily concerned with maintaining leg movement relative to a virtual hip. Neither the Precheux device nor the Berner et al. device, however, are specifically constructed to accomplish all of the objectives of the present invention.

Specifically the present invention recognizes that in the rehabilitation of the knee joint, care must be taken not to provide inappropriate constraints on the joint. This is especially true with a patient who has suffered an anterior cruciate ligament injury. As the knee flexes and extends, the articular surfaces undergo a combination of rolling and gliding movements. These movements are controlled by a combination of the forces of the muscle-tendon units, the ligamentous constraints, and the bony geometry.

During flexion and extension, the tibia undergoes a combined translational and rotational movement relative to the femur. If the cruciate ligaments are approximately isometric, that is, if they do not stretch or shorten significantly as the knee bends, then the flexion angle determines the orientation of these ligaments. The cruciate ligaments control the sliding/rolling movement needed to match the long femoral surface to the shorter tibial surface. If a constraint is added by the CPM device, the coupling between the bones changes and new and different loads are applied to the coupling structures. As an example, if the femur and foot are not properly supported during extension the tibia may be forced in an anterior direction relative to the femur. For a patient who has suffered an anterior cruciate ligament injury, this may be painful and detrimental to the rehabilitation process.

In light of the above, it is an object of the present invention to provide a CPM device which ensures full extension of the leg. Another object of the present invention is to provide a CPM device in which the tibia is not moved anteriorly relative to the femur during extension of the leg. Another object of the present invention is to provide a CPM device which requires either a continuously positive or negative rate of change in the angle of the leg as the leg is being respectively extended or flexed. Yet another object of the present invention is to provide a CPM device which maintains the cooperation of the leg with the device during cyclical operation of the device. Still another object of the present invention is to provide a CPM device which has a stall capability that establishes a threshold beyond which the patient can actively stop the operation of the device. Another object of the present invention is to provide a CPM device which is simple to operate, relatively easy to manufacture, and comparatively cost effective.

SUMMARY OF THE INVENTION

A continuous passive motion (CPM) device which is useful for achieving full extension of an articulable limb, such as the leg, includes a base on which is mounted a limb support member for holding the leg. As intended for the present invention, the limb support member is reciprocally moveable on the base between configurations wherein the leg is in various stages of flexion and a configuration wherein the leg is in full extension.

The mechanical apparatus of the limb support member which allows movement between its various configurations includes a pair of linking type assemblies which are joined together to establish a four-bar quadrangular shaped structure. One of these linking assemblies includes a tibial support bar and a drive bar, while the other assembly includes a femoral support bar and a cross bar. In their connection with each other, the femoral support bar is pivotally connected to the tibial support bar and the cross bar is pivotally connect to the drive bar. In the connection of this four-bar structure with the base of the device, the femoral support member has one end pivotally attached to the base of the device. As indicated above, the other end of the femoral support member is pivotally joined to the tibial support member. The drive bar has a first end that is slidably mounted on the base, and it has a second end which is pivotally joined to an intermediate point on the femoral support member. Together, the femoral support member and the drive bar constitute one of the linking assemblies. For the other linking assembly, the cross bar has a first end that is pivotally attached to an intermediate point on the tibial support member and a second end which is pivotally attached to an intermediate point on the drive bar. Again, as stated above, the cross bar and the tibial support member constitute the other linking assembly of the device. The drive mechanism is attached to the first end of the drive bar to reciprocate this end of the drive bar on the base. This reciprocation changes the configuration of the four-bar quadrangular shaped structure to exercise the leg which is held on both the femoral support member and the tibial support member.

In the preferred embodiment of the present invention, the CPM device includes a pair of quadrangular shaped structures which operate substantially parallel to each other. Thus, there are parallel femoral support members which are respectively connected to parallel tibial support members. Likewise, there are a pair of parallel drive bars and a pair of parallel cross bars. An adjustable foot plate is provided for adjustably supporting the foot and tibial portion of the leg. A hinged plate and a soft good are connected between the parallel femoral support members to hold the femur of a patient for movement with the femoral support members.

In the operation of the CPM device of the present invention the leg of a patient is secured to the device. Specifically, the femur is supported posteriorly and constrained anteriorly between the femoral support members. The heel of the foot is supported posteriorly and strapped to the adjustable foot plate. The drive mechanism is then activated to concertedly reciprocate the first ends of the drive bars on the base of the device. One consequence of this reciprocation of the drive bars is that the femoral support members are caused to pivot on the base. Simultaneously with the rotation of the femoral support members, the quadrangular structure is reconfigured as the tibial support members are forced to pivot on the respective femoral support members. Due to mechanical constraints in the structure of the CPM device, the direction of rotation for both the femoral support members and the tibial support members is dependent on the direction of movement of the first ends of the drive bars. Stated differently, as long as the first ends of the drive bars continue to move in one direction, the femoral support members can rotate on the base in only one direction, and the tibial support members can rotate relative to the femoral support members in only one direction. Consequently, since the mechanical constraints of the CPM device require all members to change their direction of movement together and prevent any one member from unilaterally changing its direction of movement, the drive mechanism can be set to force the leg into full extension during passive exercise of the leg. Importantly, during extension of the leg, no forces are applied to the tibia which would cause it to be forced in an anterior direction relative to the femur.

The novel features of this invention, as well as the invention itself, both as to its structure and its operation will be best understood from the accompanying drawings, taken in conjunction with the accompanying description, in which similar reference characters refer to similar parts, and in which:

BRIEF DESCRIPTION OF THE DRAWINGS

FIG. 3A is a side elevational view of the CPM device in a configuration for flexing the leg of a patient;

FIG. 3B is a side elevational view of the CPM device in a configuration for full extension of the leg of a patient; and FIG. 4 is a graph showing an idealized relationship between the angle of flexion for a leg and time during an exercise cycle, with an undesirable relationship for these variable superposed thereon.

DESCRIPTION OF THE PREFERRED EMBODIMENTS

Figure 1:
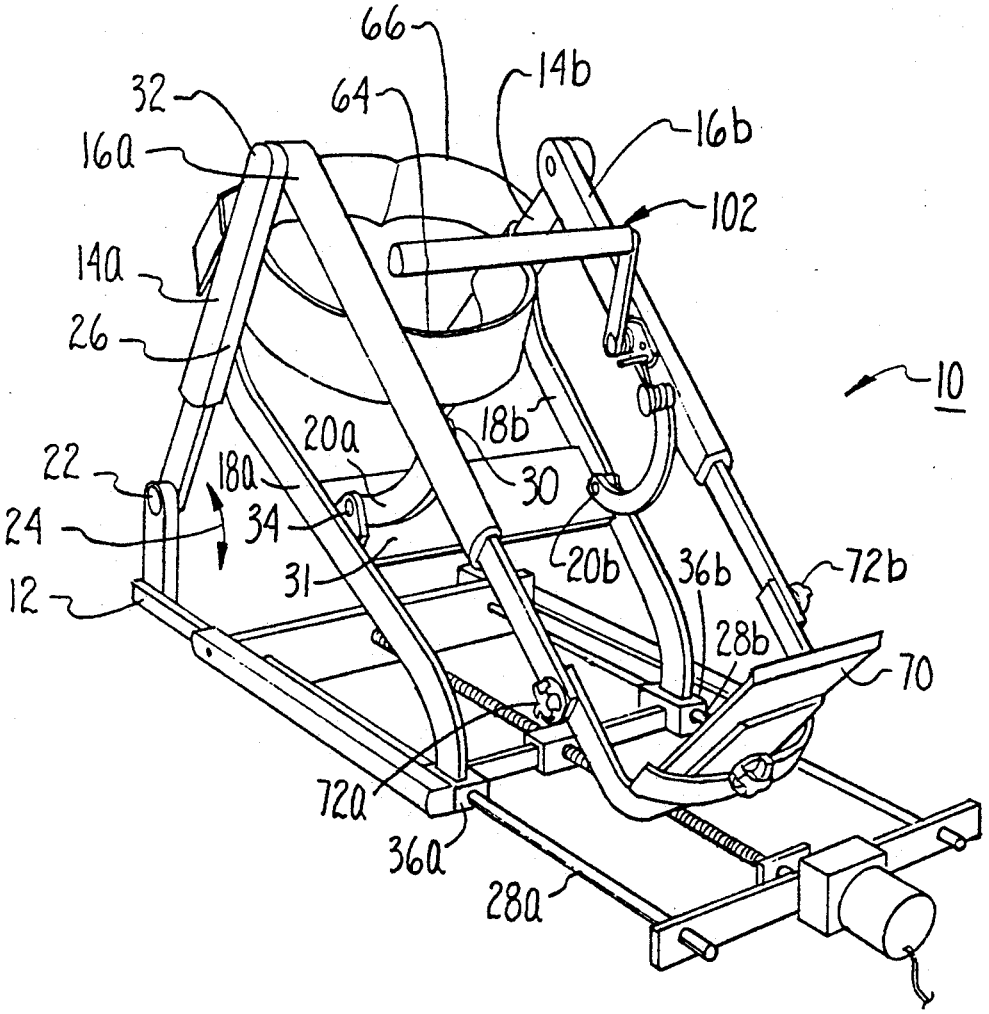
FIG. 1 is a perspective view of the CPM device of the present invention.

Referring initially to FIG. 1, a continuous passive motion device in accordance with the present invention is shown and is generally designated 10. As shown in FIG. 1, the CPM device 10 comprises a base 12 on which is mounted a limb support member. The limb support member itself is an articulatable four-bar structure which can be visualized as two interacting linkage assemblies. Although the limb support member is initially discussed here in terms of only one side of the structure, it is to be understood that the limb support member preferably includes parallel articulatable four-bar structures which operate in concert with each other.

The limb support member of device 10 includes a femoral support member **14*a* which is pivotally attached to the base 12 and also pivotally attached to a tibial support member 16*a*. Additionally, the limb support member of device 10 includes a drive bar 18*a* which has one end pivotally attached to the femoral support member 14*a* and its other end slidably mounted on the base 12. A cross bar 20*a* has one end pivotally connected to the tibial support member 16*a* and its other end pivotally connected to the drive bar 18*a*. As indicated above, this four-bar structure can be visualized as two interacting linkage assemblies. For purposes of this visualization, consider the femoral support member 14*a* and the drive bar 18*a* as comprising one pair of links, and the tibial support member 16***a* and the cross bar 20*a* as the other pair of links. A supporting member 31 joins the two drive bars 18*a* and 18*b* to rigidify the assembly.

For a more specific appreciation of the limb support member of the device 10, first consider the linkage assembly which comprises the femoral support member 14*a* and the drive bar 18*a*. For this linkage assembly, as shown in FIG. 1, the femoral support member 14*a* is pivotally connected to the base 12 at an attachment point 22 in any manner well known in the pertinent art, such as by a pivot pin. This pivotal connection allows femoral support member 14*a* to move back and forth in rotation about the attachment point 22 in the directions indicated by the arrow 24. On the other hand, drive bar 18*a* is moved in general motion. To do this, one end of the drive bar 18*a* is pivotally connected to the femoral support member 14*a* at a joint 26 which is intermediate the ends of the femoral support member 14*a*. The other end of drive bar 18*a* is mounted on the base 12 to linearly reciprocate back and forth along a track 28*a* of the base 12. As will be appreciated by the skilled artisan, the above described connections between femoral support member 14*a* and drive bar 18*a* establish a linkage type assembly having a common joint 26.

As stated above, the other linkage assembly in the limb support member of device 10 is comprised of the cross bar 20*a* and the tibial support member 16*a*. More specifically, the tibial support member 16*a* is pivotally attached to one end of the cross bar 20*a* to establish a joint 30. As shown, the joint 30 is located intermediate the ends of tibial support member 16*a*. Nevertheless, joint 30 establishes the cross bar 20*a* and the tibial support member 16*a* as a linkage type assembly. To then complete the four-bar structure for the limb support member, one end of the tibial support member 16*a* is pivotally attached to the femoral support member 14*a* at an attachment point 32, and one end of the cross bar 20*a* is pivotally attached to the at an attachment point 34. Specifically, the attachment point 32 between fedoral support member 14*a* and tibial support member 16*a* is located on femoral support member 14*a* at the end opposite from attachment point 22. Further, the end of cross bar 20*a* which is attached to drive bar 18*a* is opposite from the end of cross bar 20*a* which is pivotally attached to tibial support member 16*a* at joint 30.

It is contemplated by the present invention that the various pivot connections in the limb support member of device 10 (i.e. joints 26,30 and attachment points 22,32 and 34) can be of any type well known in the pertinent art. The important consequence of these connections is that any linear movement of the end 36*a* of drive bar 18*a* in either direction along the track 28*a* will cause an articulated movement of the limb support member of device 10. Also, it is important that as the end 36*a* moves in any one direction along track 28*a* (either to or for), the limb support member is structurally constrained so that the joints 26 and 30 must correspondingly move either toward each other or away from each other with no change in direction.

While the disclosure thus far has focused on the side of device 10 where femoral support member 14*a*, tibial support member 16*a*, drive bar 18*a*, and cross bar 20*a* are located, it is to be appreciated that a similar structure is provided on the other side of the device 10. For consistency, the corresponding structure on this other side of the device 10 are designated with the same numerical designation but with different alphabetical designations. For example, femoral support member 14*b* is connected to tibial support member 16*b* in the substantially the same manner as disclosed above for corresponding members 14*a* and 16*a*. Thus, device 10 preferably comprises a pair of parallel limb support members which move in concert with each other to support the leg of a patient during CPM therapy.

Figure 2:
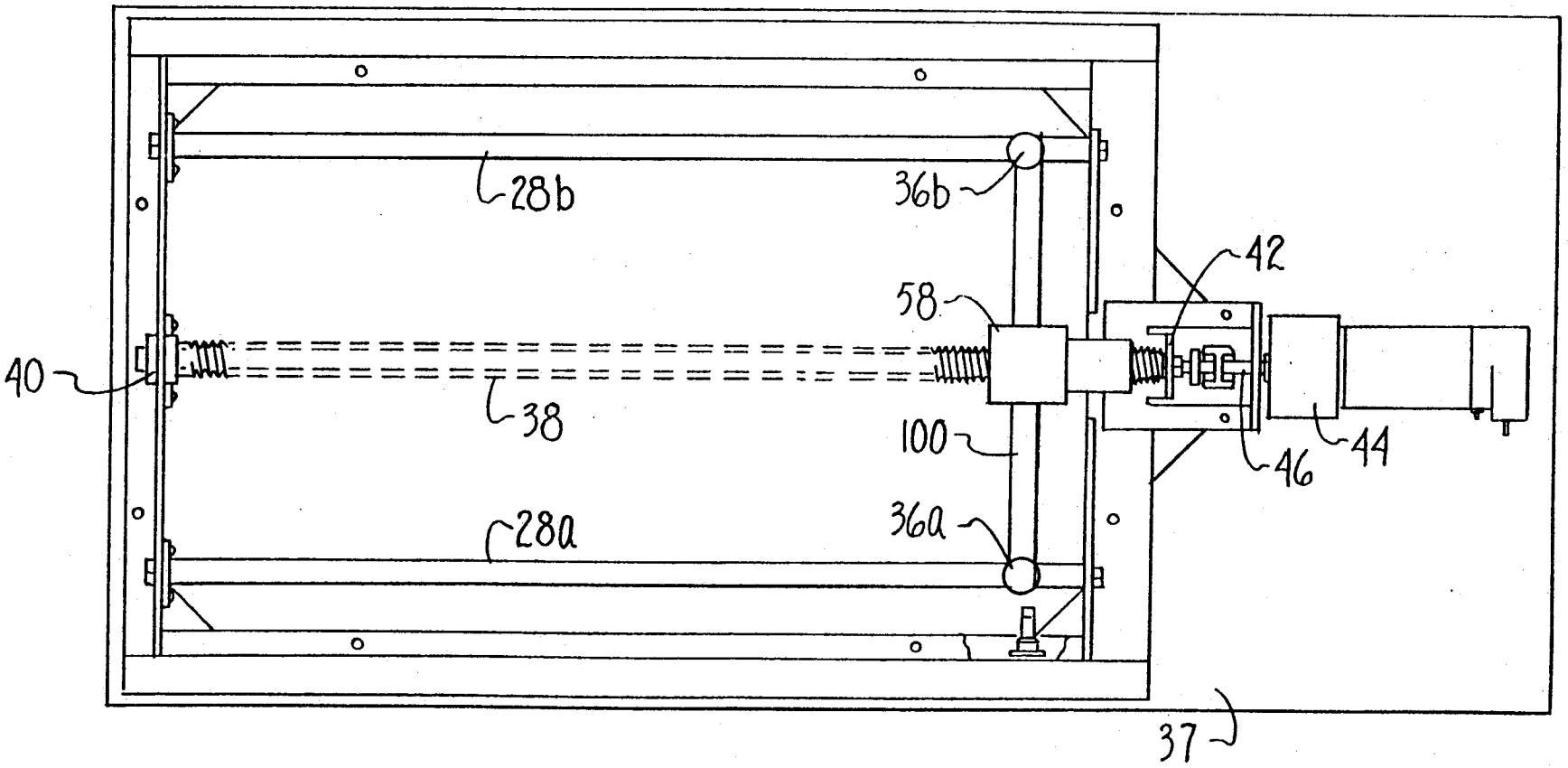
FIG. 2 is a plan view of the drive mechanism of the CPM device of the present invention with portions removed for clarity.

The drive mechanism for device 10 is best seen in FIG. 2 wherein the limb support member and the various casings have been removed from the device 10 for purposes of clarity. Specifically, the drive mechanism includes a base 37 and a single lead screw 38 which is mounted on the base 37 for rotation about its longitudinal axis. The drive mechanism also includes a pair of parallel spaced slide members 36*a,b* on which the drive bars 18 *a,b* are slidably mounted for reciprocal movement along the slide tracks 28*a, b*.

The lead screw 38 is supported between bearings 40 and 42 for rotation about its axis. The drive mechanism of device 10 also includes a dc motor 44 which rotates a drive shaft 46 in accordance with programmed input. As shown, the drive shaft 46 extends from motor 44 and is supported between the motor 44 and bearing mount 42. The actual electronics involved for input to the dc motor 44 are not shown for the device 10 as there can be many variations in the electronics involved within the contemplation of the present invention. It is to be appreciated, nevertheless, that this programmed input and the associated electronics for handling the input can be of any type well known in the pertinent art which will rotate the drive shaft in a specified direction at a specified angular velocity.

FIG. 2 also shows that a ball nut 58 is threadably mounted on the lead screw 38. A connecting cross bar 100 drivably connects the ball nut 58 to the slide members 36*a,b* drive bars 18*a,b* (FIG. 1). In accordance with the present invention, when the drive mechanism of device 10 is engaged as part of the base 12, ball nut 58 will be pivotally connected to the end 36*a* of drive bar 18*a* via connecting cross bar 100. Likewise, ball nut 58 will be pivotally connected to the end 36*b* of drive bar 18*b* via the same connecting cross bar 100. Furthermore, when ball nut 58 is so connected to the ends 36 *a,b* of drive bars 18 *a,b*, the ball nuts 58 is restrained from rotating about the longitudinal axis of lead screw 38 to which it is threadably joined. Thus, rotation of the lead screws 38 by motor 44 through the above disclosed linkages, will result in linearly movement of the ball nut 58 along the lead screw 38 and linear movements of the drive bars 18 *a,b* along the slide tracks 28,*b*.

The continuous passive motion device of the present invention also includes a patella contact member which is generally designated as 102.

OPERATION

In the operation of the continuous passive motion device 10 of the present invention, the leg 60 of a patient is positioned with the femur 62 aligned between femoral support members 14*a* and 14*b*, and the tibia 76 aligned between the tibial support members 16*a* and 16*b*. The actual positioning of leg 60 on device 10 is best seen in FIGS. 3A and 3B. To insure a firm engagement of the leg 60 with the device 10, the femur 62 is supported by a soft good 98 such as an elastomeric pad which is working in concur with a rigid hinged plate 66.

Both the soft good 98 and the rigid hinged plate 66 are attached to the femoral support members 14*a* and 14*b*. In general, the rigid hinged plate 66 and the soft good 98 work in combination to support and restrain movement of the patient's leg 60 during operation of the continuous passive motion device 10. Specifically, the soft good 98 posteriorly supports and cradles the leg 60. The rigid hinged plate 66 anteriorly constrains the leg 60 during movement by the continuous passive motion device 10. The soft good 98 is provided for support and for patient comfort reasons and as an interface between the rigid hinged plate 66 and the femur 62.

The foot 68 of the patient is then positioned against a foot rest 70 that is connected between the tibial support members 16*a* and 16*b*. As will be appreciated by the skilled artisan, the foot rest 70 can be adjusted using the three adjustment knobs 72 *a,b,c,* to accommodate the particular anatomy of the patient. The foot 68 can then be firmly held on foot rest 70 by using another soft good 74 which can be attached to the foot rest 70 and tied to the foot 68 of the patient. The foot 68 is thus supported posteriorly by the foot rest 70.

With this arrangement both the foot 68 and the femur 62 are posteriorly supported. In addition the femur is anteriorly constrained by the hinged plate 66. Accordingly during extension of the leg 60 no forces are applied to the tibia 76 which would cause it to be forced in an anterior direction relative to the femur 62.

As contemplated by the present invention, the device 10 is intended to reciprocally move the leg 60 between a flexed position (shown in FIG. 3A) and a fully extended position (shown in FIG. 3B).

This aspect of the invention can be seen with reference to FIG. 3B. In FIG. 3B, arrow 104 represents anterior constraint of the femur 62. Arrow 106 represents posterior support of the femur 62. Arrow 108 represents the posterior support of the foot 68. With this support arrangement during extension of the leg, anterior movement of the femur 62, as represented by arrow 110, is prevented. Importantly the device 10 is able to achieve full extension of the leg 60. Furthermore, due to the structure of device 10 and the connection of the leg 60 to this structure, the device 10 is designed to insure positive movement. Stated differently, the programmed movement of leg 60 from a flexed position toward full extension, or in the reverse direction, is not interrupted by an intermediate reversal of direction. Specifically, there is no interruption due to either structural limitations of the device or due to the fact that active movement of the leg 60 is able to overcome the movement of the device 10. Actually, as will be appreciated by the skilled artisan, active movement of the leg 60 can be transmitted through the limb support member and manifested as a measurable force on the ball nut 58 (FIG. 2). Within limits this can be tolerated, even though it will not cause any directional changes. On the other hand, if the reactive force from leg 60 exceeds a certain predetermined level, this can be sensed at the interaction ball nut 58 with the lead screw 38 and the operation of device 10 can be stalled. The electronic componentry and the sensors which can be used to predictably stall the device 10 in response to excessive active movement of leg 60 can be of any type well known in the pertinent art.

FIG. 4 graphically shows the prescribed movement attainable with device 10 of the present invention superposed over the possible movement of a leg 60 during CPM which is avoided by the present invention. While considering the graphs of FIG. 4, cross reference with FIGS. 3A and 3B will be helpful. First, consider that the exercise of leg 60 begins with the leg 60 in full extension as shown in FIG. 3B. This corresponds to point 82 on the graph 80 in FIG. 4. Though graph 80 is somewhat generally idealized, it is important to recognize that graph 80, like the movement of leg 60 caused by device 10, exhibits an uninterrupted positive (negative) change in angulation of the leg 60 during the time interval 84. During this time interval 84 the leg is being flexed from a fully extended configuration (shown in FIG. 3B) to a flexed configuration (shown in FIG. 3A). On graph 80, this change is shown as the transition from point 82 to point 86. Although the point 86 is shown in FIG. 4 to be approximately equal to full flexure, i.e. one hundred twenty-five degrees (125°), it is to be understood that lower angles of flexure can be programmed for device 10. In any event, once the leg 60 begins its movement from a flexed configuration at point 86 through the time interval 88 toward full extension at point 90, again there is an uninterrupted negative (positive) change in angulation of the leg 60.

Unlike the idealized movement of leg 60 by the device 10, as exemplified by graph 80, where there is an ability for the leg 60 to influence movement of a device with active motion, it is more likely that the graph 90 shown in FIG. 4 is the result. For the graph 90, it will be noticed that a reversal 92 during time interval 84, and a reversal 92' during time interval 88, are possibilities. Not only are these reversals 92 unwanted during CPM, they most likely result in the cycle ending at a point 94 where full extension has not been achieved. This deficiency is noted in FIG. 4 as the differential 96. As indicated above, an object of the present invention is to run repetitive cycles where the leg 60 is consistently subjected to full extension, i.e. points 82 and 90 should both be realized during the cycle.

While the particular continuous passive motion device as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

We claim:

1. A continuous passive motion device for moving an articulable limb through a predetermined uninterrupted reciprocal cycle to achieve full extension of the limb which comprises:

a base;

a first linkage assembly pivotably mounted on said base, said first linkage assembly comprising a first pair of longitudinal members pivotably joined at a first joint to define an included angle between said first pair of members;

a second linkage assembly comprising a second pair of longitudinal members pivotably joined at a second joint, said second linkage assembly pivotably mounted on said first linkage assembly to establish a support for the limb, said second joint being movable relative to said first joint to distance said second joint from said first joint when said included angle is decreased and to draw said second joint nearer said first joint when said included angle is increased; and means for increasing and decreasing said included angle;

wherein said first pair of longitudinal members comprise a femoral support member adapted to be attached to the patient's upper leg, and a drive bar, and wherein said second pair of longitudinal members comprise a tibial support member adapted to be attached to the patient's lower leg, and a cross bar.

2. A device as recited in claim 1 wherein said femoral support member is pivotally mounted on said base and said drive bar has a first end reciprocally mounted on said base and a second end pivotally attached to said femoral support member, and wherein said tibial support member is pivotally joined to said femoral support member and said cross bar has a first end pivotally attached to said tibial support member and has a second end pivotally attached to said drive bar.

3. A device as recited in claim 2 wherein said means for increasing and decreasing said included angle is a drive motor attached to said first end of said drive bar.

4. A device as recited in claim 3 and further comprising a soft good support attached to said femoral support member for supporting the femur posteriorly, a rigid anterior plate attached to said femoral support member for constraining the femur anteriorly, and a foot support attached to said tibial support member for supporting the foot posteriorly.

5. A device as recited in claim 4 further comprising a second femoral support member pivotally mounted on said base for a substantially parallel relationship to said femoral support member, a second tibial support member pivotally joined to said second femoral support member for a substantially parallel relationship to said tibial support member, a second drive bar having a first end reciprocally mounted on said base and a second end pivotally attached to said second femoral support member, and a second cross bar having a first end pivotally attached to said second tibial support member and having a second end pivotally attached to said second drive bar.

6. A device as recited in claim 5 wherein said rigid anterior plate and said soft good support are connected between said femoral support member and said second femoral support member.

7. A device as recited in claim 4 wherein said foot support comprises a foot rest mounted at the distal end of said tibial support member.

8. A device as recited in claim 4 wherein said second end of said drive bar is pivotally attached near approximately the midpoint of said femoral support member, and said cross bar has said second end of said cross bar pivotally attached to said drive bar intermediate said first end and said second end of said drive bar.

9. A continuous passive motion device for moving the leg of a patient through a predetermined uninterrupted reciprocal cycle to achieve full extension of the leg which comprises:

a base;

an articulated limb support member having a femoral support member adapted to be attached to the patient's upper leg and pivotally mounted on said base, and a tibial support member adapted to be attached to the patient's lower leg and pivotally joined to said femoral support member;

a drive bar having a first end reciprocally mounted on said base and a second end pivotally attached to said femoral support member;

a cross bar having a first end pivotally attached to said tibial support member and having a second end pivotally attached to said drive bar; and means for reciprocating said first end of said drive bar.

10. A device as recited in claim 9 wherein said means for reciprocating said first end of said drive bar is a drive motor attached to said first end of said drive bar.

11. A device as recited in claim 10 further comprising a second femoral support member pivotally mounted on said base for a substantially parallel relationship to said femoral support member, a second tibial support member pivotally joined to said second femoral support member for a substantially parallel relationship to said tibial support member, a second drive bar having a first end reciprocally mounted on said base and a second end pivotally attached to said second femoral support member, and a second cross bar having a first end pivotally attached to said second tibial support member and having a second end pivotally attached to said second drive bar.

12. A device as recited in claim 11 further comprising a soft good support attached to said femoral support members for supporting the femur posteriorly and a rigid anterior plate attached to said femoral support members for constraining the femur anteriorly.

13. A device as recited in claim 12 further comprising a foot rest mounted at the distal end of said tibial support member for supporting a foot of the patient posteriorly.

14. A continuous passive motion device for achieving full extension of the leg of a patient which comprises:

a base;

a pair of linkage assemblies, each said assembly having two members pivotally joined together at a joint, said pair of assemblies being joined to establish a quadrangular shaped structure mounted on said base;

means on said quadrangular shaped structure for supporting the leg; and means connected with said base for moving said quadrangular shaped structure between a first configuration wherein the leg is in flexure and a second configuration wherein the leg is fully extended;

wherein a first of said linkage assemblies comprises a femoral support member adapted to be attached to the patient's upper leg and pivotably mounted on said base, and a drive bar having a first end reciprocally mounted on said base and a second end pivotally attached to said femoral support member; and wherein a second of said linkage assemblies comprises a tibial support member adapted to be attached to the patient's lower leg and pivotally joined to said femoral support member, and a cross bar having a first end pivotally attached to said tibial support member and having a second end pivotally attached to said drive bar.

15. A device as recited in claim 14 further comprising a second quadrangular structure mounted on said base in a substantially parallel relationship to said quadrangular structure.

16. A device as recited in claim 15 further comprising a hinged anterior femoral plate and posterior soft good support connected between said quadrangular structures for holding the femur of the leg.

17. A device as recited in claim 16 further comprising a foot rest mounted at the distal end of said tibial support members of said quadrangular structures.

18. A method for passively exercising the leg of a patient to achieve a full extension of the leg which comprises the steps of:

providing a device which comprises a base, an articulated limb support member having a femoral support member adapted to be attached to the patient's upper leg and pivotally mounted on said base, and a tibial support member adapted to be attached to the patient's lower leg and pivotally joined to said femoral support member, a drive bar having a first end reciprocally mounted on said base and a second end pivotally attached to said femoral support member, a cross bar having a first end pivotally attached to said tibial support member and having a second end pivotally attached to said drive bar, a rigid plate for holding the femur of the leg for movement with said femoral member;

engaging the femur of the leg with said rigid plate; and reciprocating said first end of said drive bar on said base to alter the configuration of said device for exercising the leg.

* * * * *